US006714108B1

(12) United States Patent
Simms et al.

(10) Patent No.: US 6,714,108 B1
(45) Date of Patent: Mar. 30, 2004

(54) CIRCUIT BREAKER INCLUDING MECHANISM FOR BREAKING TACK WELD

(75) Inventors: Kevin Anthony Simms, Houston, PA (US); Jeffrey Wayne Lockhart, Pittsburgh, PA (US); Michael Joseph Erb, Fombell, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/405,894

(22) Filed: Apr. 2, 2003

(51) Int. Cl.[7] ..... H01H 75/00; H01H 77/00; H01H 3/54; H01H 1/16

(52) U.S. Cl. ..... 335/6; 335/13; 335/186; 200/240; 200/DIG. 42

(58) Field of Search ..... 335/6–15, 17, 335/156, 185, 186, 192, 194, 200; 200/238, 239, 240, 241, 242, 244, 249, 250, 253, DIG. 42

(56) References Cited

U.S. PATENT DOCUMENTS 4,158,119 A 6/1979 Krakik
4,323,871 A 4/1982 Kamp et al.
4,484,164 A 11/1984 McClellan et al.
5,184,717 A 2/1993 Chou et al.
5,313,033 A 5/1994 Link et al.
5,343,174 A 8/1994 Turner et al.
5,502,285 A 3/1996 Flohr
5,973,280 A 10/1999 Gula et al.
6,259,339 B1 7/2001 Simms et al.

*Primary Examiner*—Ramon M. Barrera
(74) *Attorney, Agent, or Firm*—Martin J. Moran

(57) ABSTRACT

A circuit breaker includes a housing having an elongated pivot opening, a movable arm, a fixed contact and a movable contact mounted on the arm. The contacts and the arm cooperate to provide closed, pivot and open states. The pivot opening mounts a pivot end of the arm for pivotal and longitudinal movement. A solenoid includes a plunger coupled to the arm. The plunger moves between deactuating and actuating positions to provide the open and closed states, respectively. The plunger has a pivot position between the deactuating and actuating positions. The pivot end moves to a first longitudinal position in the pivot and open states, and moves to a second longitudinal position in the closed state. When the contacts are welded closed, the solenoid provides insufficient force to move the plunger to the deactuating position until after the pivot end moves at least substantially toward the first longitudinal position.

18 Claims, 7 Drawing Sheets

CIRCUIT BREAKER INCLUDING MECHANISM FOR BREAKING TACK WELD

CROSS-REFERENCE TO RELATED APPLICATION

This application is related to commonly assigned, concurrently filed U.S. patent application Ser. No. 10/405,739, filed Apr. 2, 2003, entitled "Remotely Controllable Circuit Breaker Including Bypass Magnet Circuit".

BACKGROUND OF THE INVENTION

1. Field of the Invention

This invention relates to circuit breakers for protecting electric power circuits and, more particularly, to such circuit breakers including a mechanism for breaking a tack weld between separable contacts.

2. Background Information

Circuit breakers used in residential and light commercial applications are commonly referred to as miniature circuit breakers because of their limited size. Such circuit breakers typically have a set of separable contacts opened and closed by a spring powered operating mechanism. A thermal-magnetic trip device actuates the operating mechanism to open the separable contacts in response to persistent overcurrent conditions and to short circuit conditions.

When a movable contact arm of a circuit breaker, electrical contactor or electrical relay is actuated, for example, by a solenoid or motor, it is necessary, under certain circumstances, to be able to open a relatively small tack weld that has formed on the faces of the separable contacts. In some circumstances, the actuating mechanism is not able to generate enough force on the movable contact arm to break the tack weld and open the separable contacts.

There is room for improvement in circuit breakers including a mechanism for breaking a tack weld between separable contacts.

SUMMARY OF THE INVENTION

These needs and others are met by the present invention, which provides improvements in rocking separable contacts, in order to achieve a peeling action on the separable contact faces, in combination with increasing the force of an actuator, such as a solenoid, in order to assist in breaking a relatively light tack weld.

Whenever an actuator, such as a solenoid, opens the separable contacts, the plunger of the solenoid freely moves a pivot of a movable contact arm to one end of a pivot opening. This accomplishes two purposes: (1) a peeling action is provided on the faces of the separable contacts, thereby reducing the force needed to break the tack weld; and (2) a gap within the solenoid between the solenoid core and the solenoid plunger is reduced, thereby increasing the opening force of the solenoid plunger. These synergistic actions reduce the force needed to break the tack weld and, also, increase the opening force as provided by the solenoid plunger, in order to break such tack weld.

In accordance with the invention, an electrical switching apparatus comprises: a housing comprising a pivot opening having a first end and a second end; a movable arm including a first portion having a pivot pivotally mounted in the pivot opening and a second portion, the pivot opening being substantially larger than the pivot; a fixed contact mounted in the housing; a movable contact mounted on the second portion of the movable arm, the fixed contact, the movable contact and the movable arm cooperating.to provide a closed state, a pivot state and an open state; an actuator mounted in the housing, the actuator including a member coupled to the movable arm, the actuator moving the member between a first position and a second position to provide the open state and the closed state, respectively, the member having a third position between the first position and the second position; and means for biasing the movable arm toward the fixed contact to maintain the closed state; wherein the closed state is defined by the second position of the member of the actuator, with the pivot engaging the second end of the pivot opening and being apart from the first end of the pivot opening, wherein the pivot engages the first end of the pivot opening and is apart from the second end of the pivot opening in the pivot state, wherein the open state is defined by the first position of the member of the actuator, with the pivot engaging the first end of the pivot opening and being apart from the second end of the pivot opening, and wherein when the fixed contact and the movable contact are welded closed, the actuator provides insufficient force to move the member of the actuator to the first position until after the pivot moves apart from the second end of the pivot opening and at least substantially toward the first end of the pivot opening.

The actuator may be a solenoid having a core and at least one coil wound on the core, and the member may be a plunger of the solenoid. The plunger may engage the core in the first position, be set apart from the core with a first gap in the third position, and be further set apart from the core with a larger second gap in the second position. The at least one coil may include a closing coil and an opening coil, and the opening coil may energize the core to attract the plunger with a first force in the third position, and a second smaller force in the second position.

The pivot may have a size within the pivot opening. A distance between the first end and the second end of the pivot opening may be about twice the size of the pivot.

As another aspect of the invention, a remotely controllable circuit breaker comprises: a housing comprising a pivot opening having a first end and a second end; a first terminal; a second terminal; a set of first contacts mounted in the housing; an operating mechanism mounted in the housing and coupled to the set of first contacts for opening and closing the set of first contacts; a movable arm including a first portion having a pivot pivotally mounted in the pivot opening and a second portion, the pivot opening being substantially larger than the pivot; a set of second contacts comprising a fixed contact mounted in the housing and a movable contact mounted on the second portion of the movable arm, the fixed contact, the movable contact and the movable arm cooperating to provide a closed state, a pivot state and an open state, the set of second contacts being electrically interconnected with the set of first contacts between the first and second terminals; a remotely controllable solenoid including a member coupled to the movable arm, the remotely controllable solenoid moving the member between a first position and a second position to provide the open state and the closed state, respectively, the member having a third position between the first position and the second position; and means for biasing the movable arm toward the fixed contact to maintain the closed state, wherein the closed state is defined by the second position of the member of the actuator, with the pivot engaging the second end of the pivot opening and being apart from the first end of the pivot opening, wherein the pivot engages the first end of the pivot opening and is apart from the second end of the pivot opening in the pivot state, wherein the open state is defined by the first position of the member of the actuator, with the pivot engaging the first end of the pivot opening and being apart from the second end of the pivot opening, and wherein when the fixed contact and the movable contact are welded closed, the actuator provides insufficient force to move the member of the actuator to the first position until after the pivot moves apart from the second end of the pivot opening and at least substantially toward the first end of the pivot opening.

The fixed contact and the movable contact may include opposing faces, which are engaged in the closed state and are disengaged in the open state. When the opposing faces are welded closed, the pivot state separates a portion of the opposing face of the movable contact from the opposing face of the fixed contact.

As another aspect of the invention, an electrical switching apparatus comprises: a housing; a movable arm including a first portion and a second portion; means for mounting the first portion of the movable arm for pivotal movement and longitudinal movement with respect to the housing; a fixed contact mounted in the housing; a movable contact mounted on the second portion of the movable arm, the fixed contact, the movable contact and the movable arm cooperating to provide a closed state, a pivot state and an open state; and an actuator mounted in the housing, the actuator including a member coupled to the movable arm, the actuator moving the member between a deactuating position and an actuating position to provide the open state and the closed state, respectively, the member having a pivot position between the deactuating position and the actuating position, wherein the closed state is defined by the actuating position of the member of the actuator, wherein the first portion of the movable arm moves to a first longitudinal position in the pivot state and in the open state, wherein the first portion of the movable arm moves to a second longitudinal position in the closed state, and wherein when the fixed contact and the movable contact are welded closed, the actuator provides insufficient force to move the member of the actuator to the deactuating position until after the first portion of the movable arm moves at least substantially toward the first longitudinal position in the pivot state.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the statement that two or more parts are "coupled" together shall mean that the parts are joined together either directly or joined through one or more intermediate parts. Further, as employed herein, the statement that two or more parts are "attached" shall mean that the parts are joined together directly.

Figure 1:
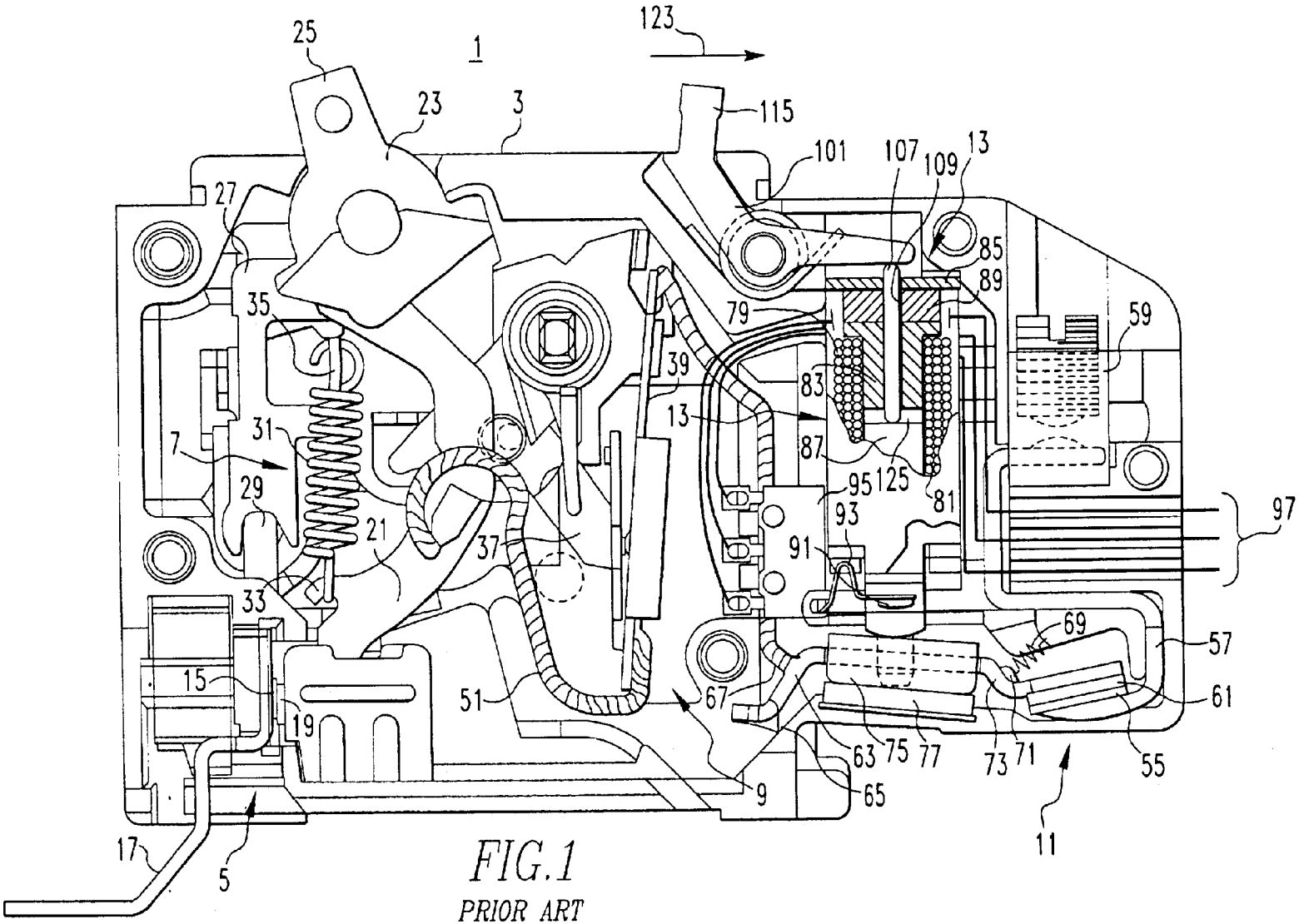
FIG. 1 PRIOR ART
FIG. 1 is an elevational view of a remotely controllable circuit breaker shown with the cover removed and with the main contacts and secondary contacts closed.

The invention will be described as applied to a miniature circuit breaker, although it will become apparent that it could be applied to other types of circuit breakers as well. An example of a miniature remotely controllable circuit breaker is disclosed in U.S. Pat. No. 6,259,339, which is incorporated by reference herein. Referring to FIG. 1, a miniature circuit breaker 1 includes a molded housing 3 with the cover of the housing removed. The basic components of the circuit breaker 1 are a set of main contacts 5, an operating mechanism 7 for opening such main contacts, and a thermal-magnetic trip device 9, which actuates such operating mechanism to trip the set of main contacts 5 open in response to certain overcurrent conditions. Further included arc a set of secondary contacts 11 and an actuator 13 in the form of a magnetically latchable solenoid 13, which is remotely controllable to control the open and closed states of the set of secondary contacts 11. Finally, the circuit breaker 1 includes an operating member/indicator member 101, to be described, for manually closing the set of secondary contacts 11 and which also serves as a position indicator to provide a visual indication external to the molded housing 3 of the open/closed state of the set of secondary contacts 11.

The set of main contacts 5 includes a fixed contact 15 secured to a line terminal 17 and a movable main contact 19 affixed to an arcuate movable contact arm 21, which forms part of the operating mechanism 7, for opening and closing such main contacts. The operating mechanism 7 is a well-known device, which includes a pivotally mounted operator 23 with an integrally molded handle 25. The operating mechanism 7 also includes a cradle 27 pivotally mounted on a support 29 molded in the housing 3. With the handle 25 in the closed position, as shown in FIG. 1, a spring 31 connected to a hook 33 on the movable contact arm 21 and a tab 35 on the cradle 27 holds the main contacts 5 closed. The spring 31 also applies a force with the set of main contacts 5 closed, as shown, to the cradle 27 which force tends to rotate such cradle in a clockwise (with respect to FIG. 1) direction about the support 29. However, the cradle 27 has a finger 37, which is engaged by the thermal-magnetic trip device 9 to prevent this clockwise rotation of such cradle under normal operating conditions. Otherwise, as is well-known, the trip device 9 pivots counter-clockwise (with respect to FIG. 1) to unlatch the finger 37 and, thus, the cradle 27, in order to trip open the set of main contacts 5.

The set of secondary contacts 11 includes a fixed secondary contact 55 secured on a load conductor 57, which leads to a load terminal 59. The set of secondary contacts 11 also includes a movable secondary contact 61 fixed to a secondary movable contact arm 63, which at its opposite end is seated in a molded pocket 65 in the molded housing 3. The movable contact arm 63 is electrically connected in series with the set of main contacts 5 by a flexible braided conductor 67 connected to the upper (with respect to FIG. 1) or fixed end of the bimetal 39. The free end of the bimetal 39 is electrically connected to the main movable contact arm 21 by a flexible braided conductor 51. Thus, a circuit for load current is established from the line terminal 17 through the set of main contacts 5, the main movable contact arm 21, the flexible braided conductor 51, the bimetal 39, the flexible braided conductor 67, the secondary movable contact arm 63, the set of secondary contacts 11, and the load conductor 57 to the load terminal 59.

The set of secondary contacts 11 is biased to the closed state of FIG. 1 by a helical compression spring 69 seated on a projection 71 on an offset 73 in the secondary movable contact arm 63. The spring 69 is oriented such that the force that it applies to the movable contact arm 63, which tends to close the set of secondary contacts 11, is relaxed to a degree with such secondary contacts in the open position. This serves the dual purpose of providing the force needed to close the set of secondary contacts 11 against rated current in the protected circuit and, also, reducing the force that must be generated by the magnetically latching solenoid 13 to hold such secondary contacts in the open state. In order for the set of secondary contacts 11 to withstand short circuit currents and allow the set of main contacts 5 to perform the circuit interruption, the magnet force generated by the short circuit current causes a movable armature 75 mounted on the secondary movable contact arm 63 to be attracted to a fixed pole piece 77 seated in the molded housing 3, thereby clamping the set of secondary contacts 11 closed.

The actuator/solenoid 13 includes a first or close coil 79 and a second or open coil 81 concentrically wound on a steel core 83 supported by a steel frame 85. A plunger 87 moves rectilinearly within the coils 79 and 81. A permanent magnet 89 is seated between the steel core 83 and the steel frame 85.

The plunger 87 engages the secondary contact arm 63 to cooperatively form a closing member. When the close coil 79 is energized, a magnetic field is produced to drive the plunger 87 downward to a first position, which rotates the secondary movable contact arm 63 clockwise (with respect to FIG. 1) and thereby moves the set of secondary contacts 11 to the closed state. The set of secondary contacts 11 is maintained in the closed state by the spring 69. When it is desired to open the set of secondary contacts 11, the open coil 81 is energized, which lifts the plunger 87 and with it the secondary movable contact arm 63 to open such secondary contacts. With the plunger 87 in the full upward position of FIG. 2, it contacts the steel core 83 and is retained in this second position by the permanent magnet 89. Subsequently, when the close coil 79 is energized, the magnetic field generated is stronger than the field of the permanent magnet 89 and, therefore, overrides the latter and moves the plunger 87 back to the first, or closed position. A projection 91 on the plunger 87 engages an actuating lever 93 on a microswitch 95, which controls remote operation of the solenoid 13 by signals provided over a remotely operable control circuit represented by control leads 97. As the set of secondary contacts 11 are held closed by the spring 69 and held open by the magnetic latching provided by the permanent magnet 89, only momentary signals are needed to operate such secondary contacts to the open and closed states.

Figure 2:
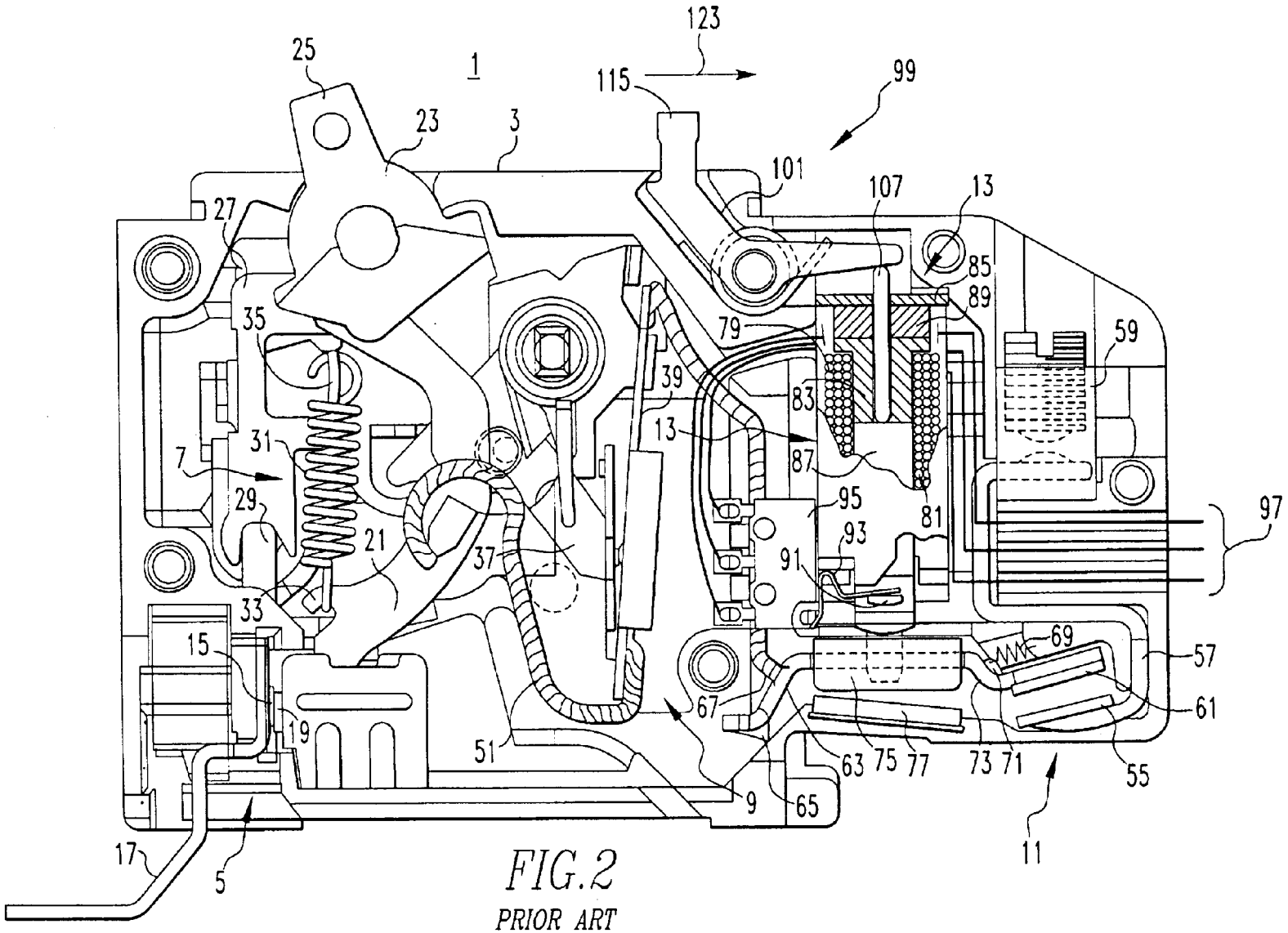
FIG. 2 PRIOR ART
FIG. 2 is a view similar to that of FIG. 1 with the secondary contacts open.

With the set of secondary contacts 11 open, as shown in FIG. 2, an extension 115 can be pushed to the right (with respect to FIG. 2) as shown by the arrow 123, to rotate the operating member/indicator member 101 clockwise (with respect to FIG. 2), thereby depressing a coupling pin 107 and driving the plunger 87 downward to open a gap 125 (as shown in FIG. 1) between the core 83 and the plunger 87, in order that the set of secondary contacts 11 is closed and held closed by the spring 69.

Figure 3:
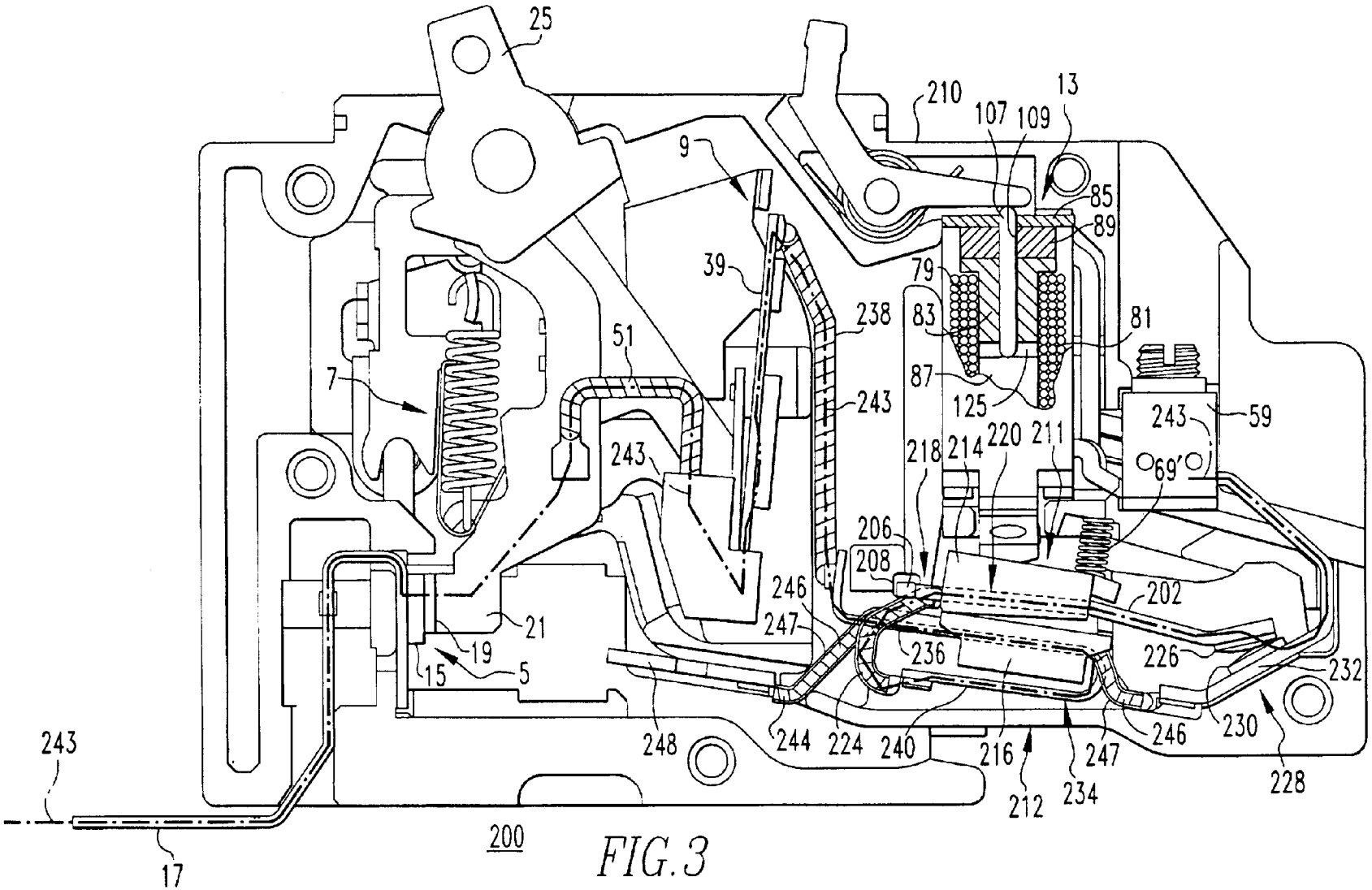
FIG. 3 is an elevational view of a remotely controllable circuit breaker in accordance with the invention shown with the cover removed and with the main contacts and secondary contacts closed.

Referring to FIG. 3, a remotely controllable circuit breaker 200 in accordance with the present invention is shown. For convenience of disclosure, the circuit breaker 200 includes some of the features of the circuit breaker 1 of FIGS. 1 and 2, which features are shown with common reference numerals, such as, for example, the line terminal 17, the set of main contacts 5, the operating mechanism 7, the bimetal 39, the solenoid 13, and the load terminal 59.

Figure 5:
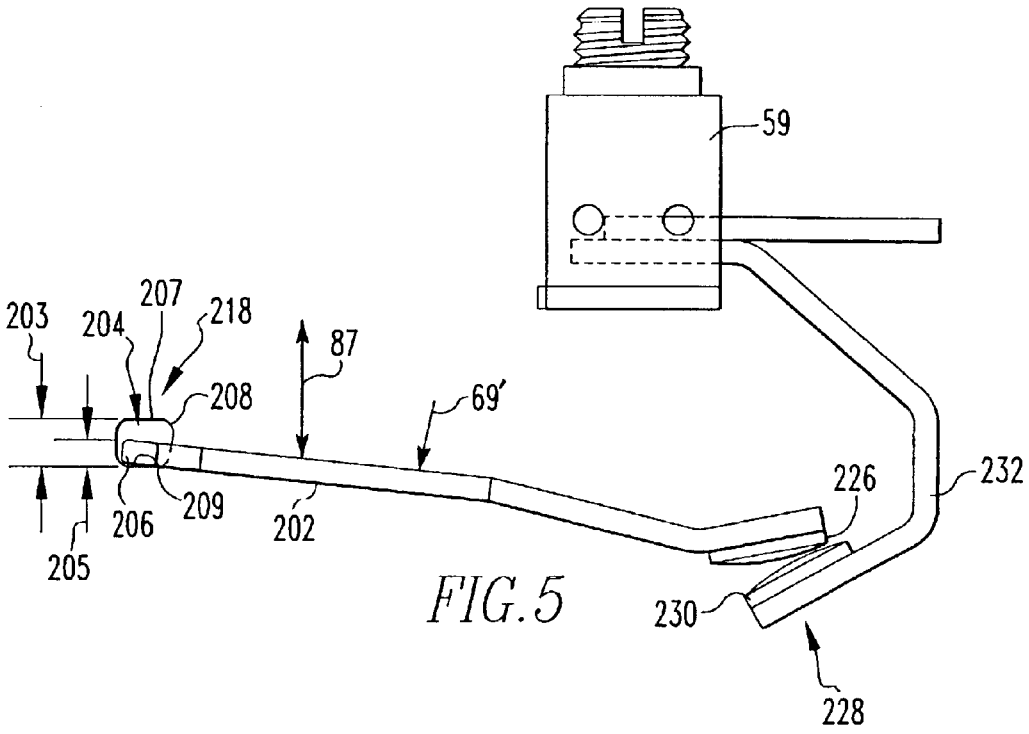
FIG. 5 is a simplified elevational view of the secondary contact arm and secondary contacts of FIG. 3.

As best shown in FIG. 5, the circuit breaker 200 of FIG. 3 includes a secondary movable contact arm 202 having a T-shaped pivot end 204 with two pivot legs 206 (only one is shown) mounted in two corresponding oversized openings 208 (only one is shown) in a molded housing 210. The pivot opening 208 has a first or upper (with respect to FIG. 5) end 207 and a second or lower (with respect to FIG. 5) end 209. Although pivot legs on a movable contact arm and a pivot opening in a molded housing are shown, the invention is applicable to any suitable mechanism for mounting one portion of a movable contact arm, such as 202, for pivotal movement and longitudinal movement with respect to a housing, such as 210. For example, the housing 210 could provide one or more pivot points (not shown) and the movable contact arm 202 could provide an elongated pivot opening (not shown), which receives such pivot points.

The opening force for the secondary movable contact arm 202 is provided by the plunger 87 of the solenoid 13 of FIG. 3 or by any suitable electric solenoid or motor. The closing force for the secondary movable contact arm 202 may be provided by the plunger 87, and is preferably also provided by spring 69'. An actuator assembly 211 includes the actuator/solenoid 13 and its plunger 87 along with the secondary movable contact arm 202 and the helical compression spring 69', which cooperate to selectively move the set of secondary contacts 228 between the open and closed states.

Figure 4:
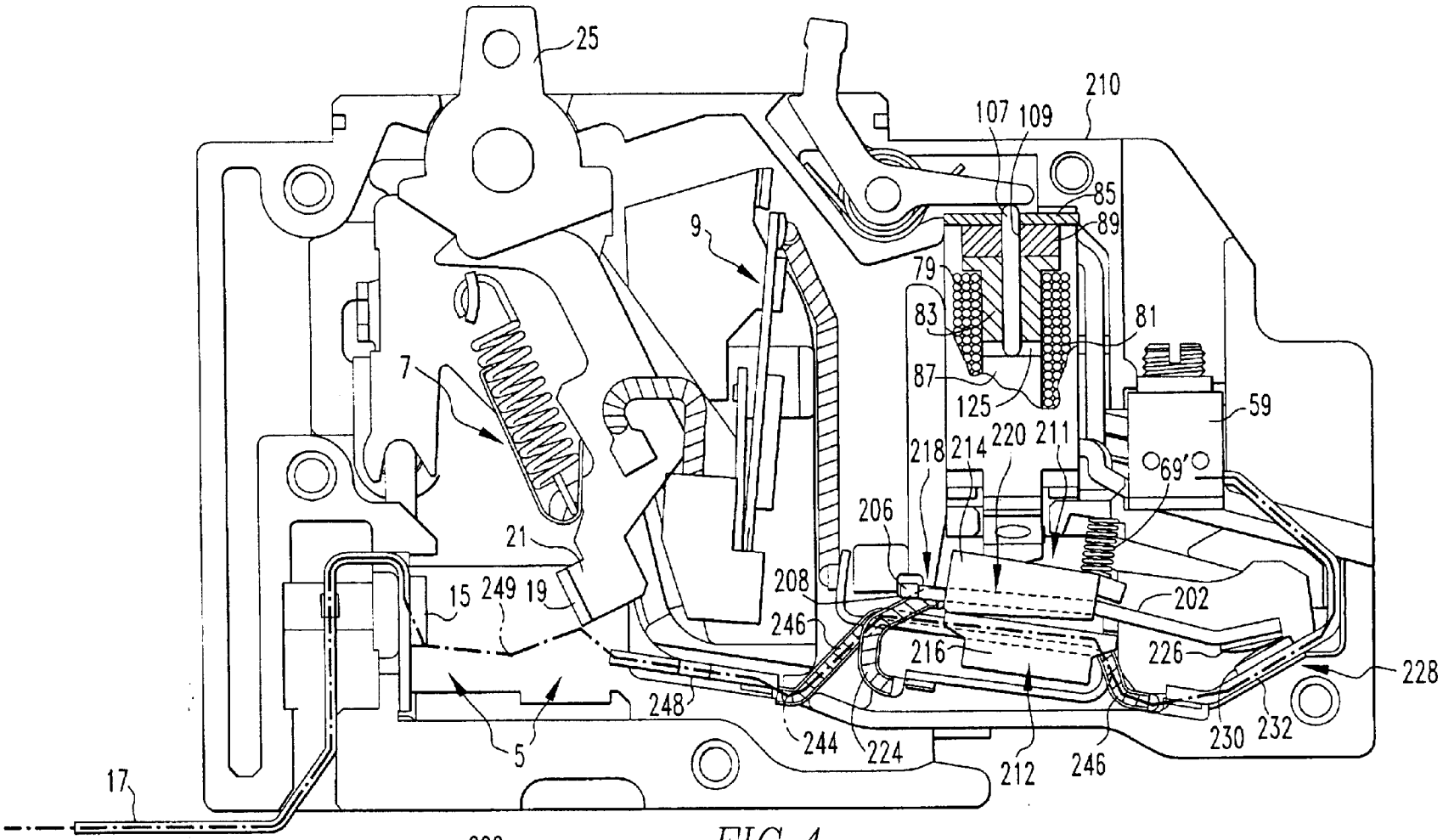
FIG. 4 is a view similar to that of FIG. 3 with the main contacts open.
Figure 6:
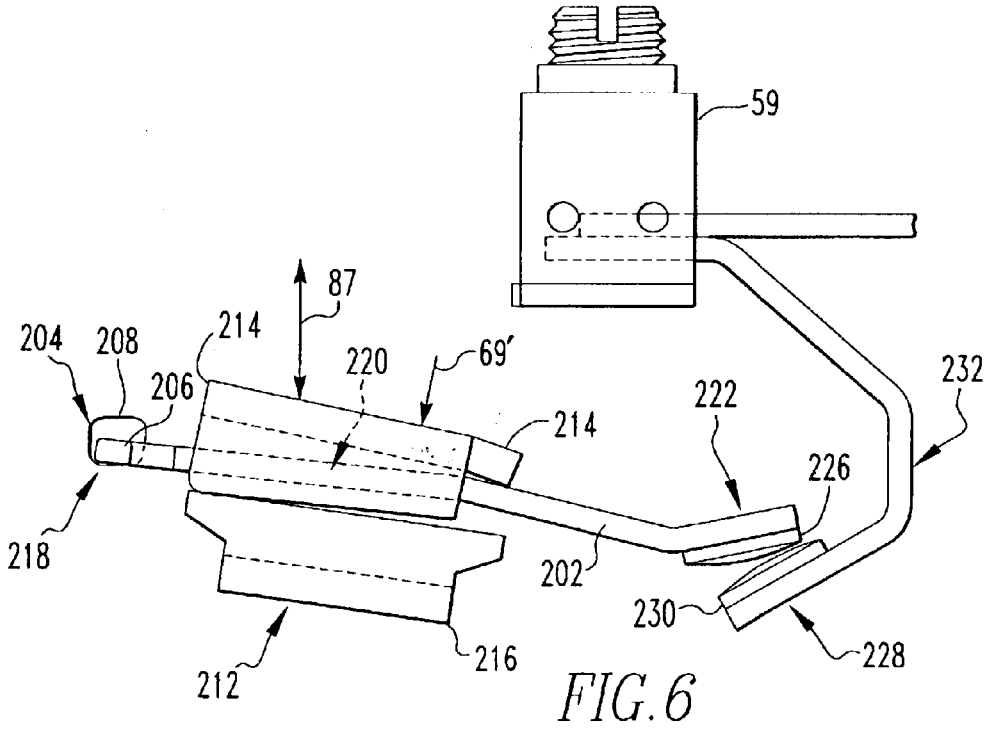
FIG. 6 is a view similar to that of FIG. 5, but also including the fixed and movable armatures of FIG. 3.
Figure 7:
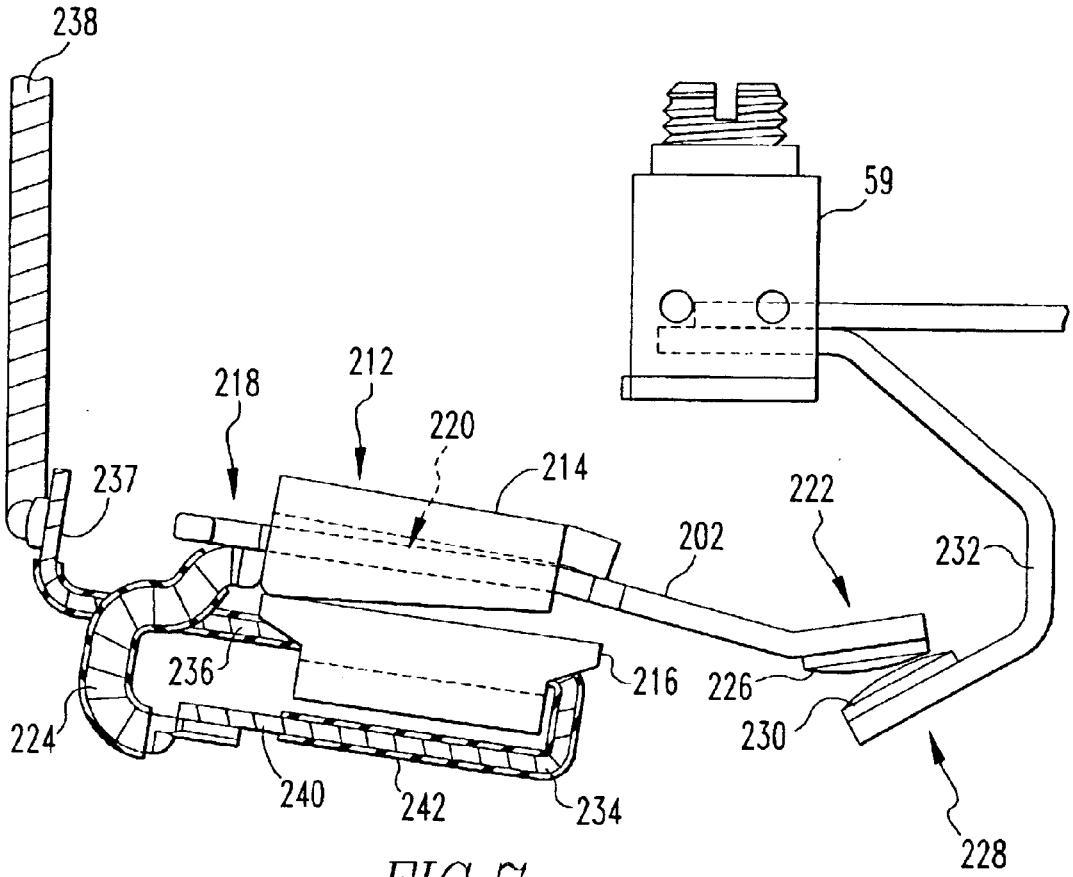
FIG. 7 is a view similar to that of FIG. 6, but also showing the current path of the primary circuit of FIG. 3.

As best shown in FIG. 6, a magnetic armature assembly 212 includes a first or movable magnetic armature 214 coupled to (e.g., suitably mounted on) the secondary movable contact arm 202, and a second or fixed magnetic armature (e.g., pole piece) 216 seated in the molded housing 210 of FIGS. 3 and 4. The secondary movable contact arm 202 includes a first portion 218, an intermediate second portion 220 and a third portion 222. As best shown in FIG. 7, near the first portion 218, the movable contact arm 202 is electrically connected to a flexible braided conductor 224 (and, in turn, to a current loop 234). The second portion 220 of such arm is positioned between the first and second magnetic armatures 214,216, and the third portion 222 is fixed to and carries a movable secondary contact 226. A set of secondary contacts 228 includes the movable secondary contact 226 and a fixed secondary contact 230 secured on a load conductor 232, which leads to the load terminal 59 (FIGS. 3 and 4).

As best shown in FIG. 5, the first portion 218 of the movable contact arm 202 has the pivot legs 206 pivotally mounted in the pivot opening 208, which is substantially larger than the pivot legs 206. For example, the pivot legs 206 have a size 205 within the pivot opening 208, and the distance 203 between the first end 207 and the second end 209 of the pivot opening 208 is about twice the size 205 of the pivot legs 206.

Figure 9:
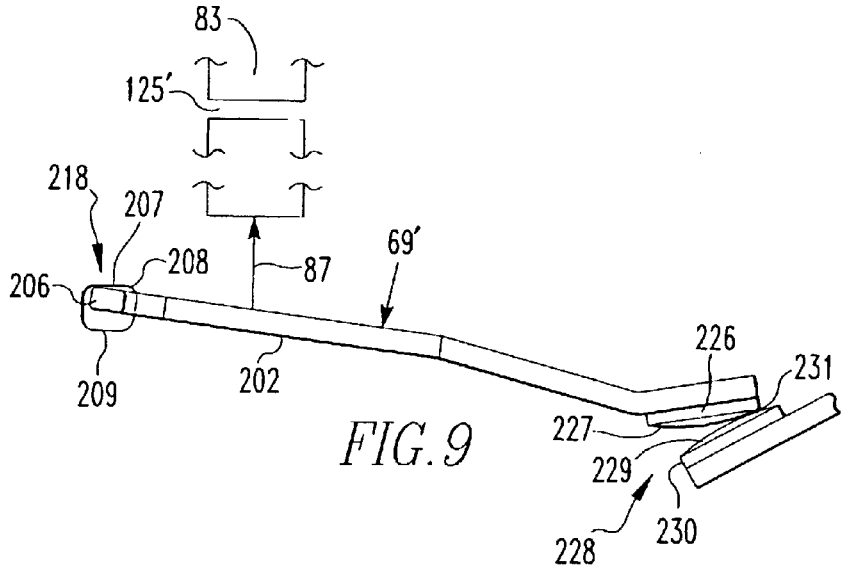
FIG. 9 is a simplified elevational view of the secondary contact arm and secondary contacts of FIG. 3 in the pivot state.
Figure 10:
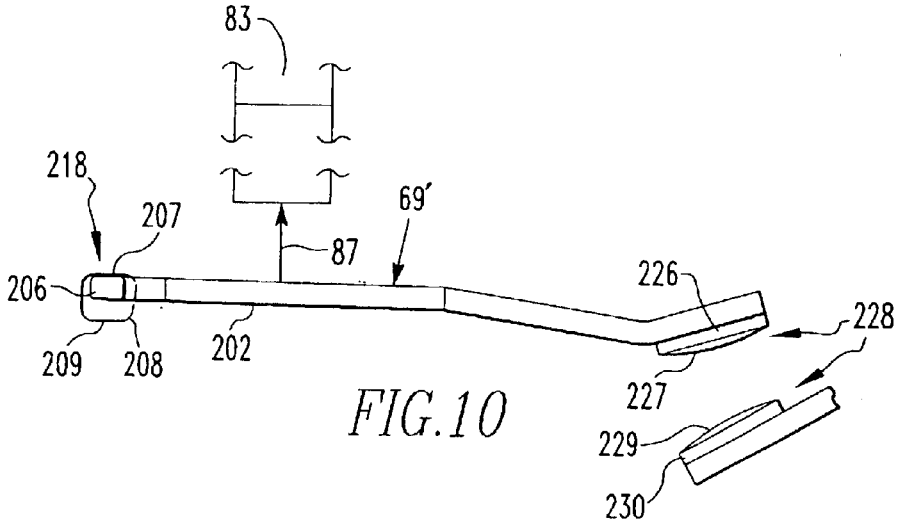
FIG. 10 is a simplified elevational view of the secondary contact arm and secondary contacts of FIG. 3 in the open state.

As discussed below in connection with FIGS. 8–10, the fixed contact 230, the movable contact 226 and the movable contact arm 202 cooperate to provide a closed state (FIG. 8), a pivot state (FIG. 9) and an open state (FIG. 10). The fixed contact 230 and the movable contact 226 include opposing faces 229,227 (FIG. 10), respectively, which are engaged in the closed state and are disengaged in the open state. As shown in FIG. 9, when the opposing faces 227,229 are welded closed at 231, the pivot state separates a portion of the opposing face 227 of the movable contact 226 from the opposing face 229 of the fixed contact 230. Preferably, the opposing faces 227,229 have arcuate cross-sections.

Referring again to FIG. 6, the set of magnetic armatures 214,216 is preferably employed to clamp the set of secondary contacts 228 closed during relatively high current conditions, such as a short circuit. These magnetic armatures are U-shaped forms, which wrap around the secondary movable contact arm 202. In addition to the magnetic armatures 214,216, the spring 69' (FIG. 3) may bias the movable contact arm 202 toward the fixed contact 230 to maintain the closed state. The spring 69' is oriented such that the force that it applies to the movable contact arm 202 tending to close the set of secondary contacts 228 is relaxed to a degree with such secondary contacts in the contact welded position (FIG. 9), and is further relaxed to a degree with such secondary contacts in the open position (FIG. 10). Hence, the spring 69' reduces a force applied to the movable contact arm 202 and toward the fixed contact 230 as the solenoid 13 (FIG. 3) moves the plunger 87 from its closed or lower (with respect to FIGS. 3 and 4) position at least substantially toward its intermediate position (FIG. 9), which moves the pivot legs 206 from the second or lower end 209 of the pivot opening 208 at least substantially toward the first or upper end 207 of such pivot opening.

Referring to FIG. 7, the exemplary current loop 234 is a solid conductor form (e.g., copper), which raps around the fixed magnetic armature 216. The loop 234 is U-shaped and includes a first leg 236 having a foot 237, which is electrically interconnected with the bimetal 39 (FIGS. 3 and 4) and, thus, with the set of main contacts 5 by a flexible braided conductor 238. The loop 234 also includes a second leg 240, which is electrically interconnected with the secondary movable contact arm 202 and, thus, with the set of secondary contacts 228 by the flexible braided conductor 224. The first leg 236 passes between the first and second magnetic armatures 214,216. Preferably, an insulating or molded barrier 242 insulates the current loop 234 from the magnetic armatures 214,216.

Referring again to FIG. 3, a primary circuit 243 for load current is established from the line terminal 17 through the set of main contacts 5, the main movable contact arm 21, the flexible braided conductor 51, the bimetal 39, the flexible braided conductor 238, the current loop 234, the flexible braided conductor 224, the secondary movable contact arm 202, the set of secondary contacts 228, and the load conductor 232 to the load terminal 59. This primary circuit 243 electrically connects the set of main contacts 5 to the set of secondary contacts 228 between the line and load terminals 17,59. Through the first leg 236 of the current loop 234 and the intermediate second portion 220 of the secondary movable contact arm 202, the primary circuit 243 passes between the first and second magnetic armatures 214,216, which are responsive to a first predetermined condition (e.g., a short circuit or other fault condition) of current flowing therein. Hence, these two turns (i.e., the first current loop leg 236 and the intermediate second portion 220 of the secondary movable contact arm 202) of the primary circuit 243 cooperate with the armatures 214,216 to hold the set of secondary contacts 228 in the closed state during that condition of current, thereby clamping such secondary contacts closed.

An alternate or bypass magnetic circuit 244 is provided for arcing current. As shown in FIG. 4, the set of main contacts 5 has just been opened by the operating mechanism 7 in response to a short circuit condition or other fault condition. The alternate circuit 244 includes a flexible braided conductor 246, which is electrically connected between an arc plate 248 and the load conductor 232 and, thus, to the load terminal 59. Preferably, the conductor 246 is insulated by a suitable insulator 242. As is well-known, the arc plate 248 draws an arc 249 from the main fixed contact 15 when the main movable contact arm 21 opens the set of main contacts 5 under short circuit or other fault conditions. An arc chute (not shown) may be employed in the vicinity of the arc 249 and arc plate 248. A small percentage of current may still conduct through the primary circuit 243 until the arc 249 is extinguished. The alternate circuit 244 passes between the first and second magnetic armatures 214,216, which are responsive to the arcing condition of current flowing in that circuit and which cooperate to hold the set of secondary contacts 228 in the closed state during that arcing condition of current.

In the alternate circuit 244, the arcing current is established from the line terminal 17 through the main fixed contact 15, the arc 249, the arc plate 248, the flexible braided conductor 246, and the load conductor 232 to the load terminal 59. At least initially, the arcing current is about equal to the fault current, although the arcing current is quickly reduced as the arc 249 is quenched. Nevertheless, the corresponding force, as provided by the magnetic armatures 214,216 in response to the arcing current in the alternate circuit 244, continues after the time that the other force, as provided by the magnetic armatures 214,216 in response to the fault current in the primary circuit 243 has ceased as a result of the interruption of that fault current by the separation of the set of main contacts 5.

When the exemplary bypass magnetic circuit 244 is used with the set of main circuit breaker contacts 5, the bypass energy advantageously increases and/or lengthens the duration of the clamping power of the magnetic armatures 214,216. As shown in FIGS. 3 and 4, due to the nature of the alternate circuit 244, a majority of the energy that was passing through the circuit breaker 200 in the primary circuit 243 (FIG. 3) is now redirected from the movable main contact 19, in order to limit the damage under fault current conditions. As the energy decreases in the two turns of the primary circuit 243 (i.e., the first current loop leg 236 and the intermediate second portion 220 of the secondary movable contact arm 202), the corresponding magnetic hold down force on the set of secondary contacts 228 is also decreased. To help minimize that loss, the current path from the bypass magnetic circuit 244 is directed through the magnetic armatures 214,216 as shown in FIG. 4. This increases the magnetic holding force and, at the same time, provides an alternate path for current. This further limits the amount of damage incurred by the set of secondary contacts 228.

Although the flexible braided conductor 246 is shown as being electrically connected to one end of the load conductor 232 and, thus, indirectly to the fixed secondary contact 230, it may alternatively be electrically connected directly to the load terminal 59 or at about the fixed secondary contact 230. For example, in order to increase the clamping force of the magnetic armatures 214,216, the primary current path may be routed by one or more loops (not shown) to provide more "amp-turns". The increased amp-turns increase the magnetic force that the movable armature 214 places on the secondary movable contact arm 202. This force, in turn, increases the contact force of the set of separable contacts 228. As another example, a flexible braided conductor (not shown) may be electrically connected between the bimetal 39 (FIG. 3) and the secondary movable contact arm 202, and pass between the first and second magnetic armatures 214,216 for one or more turns, before being electrically connected to that arm 202. Preferably, a suitable insulating barrier (not shown) is disposed between such conductor and the first and second magnetic armatures 214,216.

Figure 8:
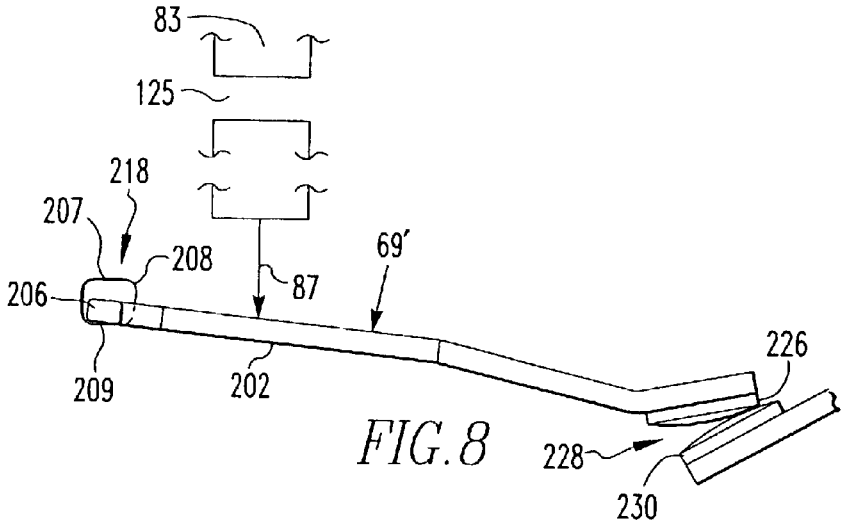
FIG. 8 is a simplified elevational view of the secondary contact arm and secondary contacts of FIG. 3 in the closed state.

FIG. 8 shows the closed state of the secondary separable contacts 228 in which an opening force is induced on the secondary movable contact arm 202 through the plunger 87 of the solenoid 13 of FIG. 3. When a relatively light tack weld (e.g., 231 of FIG. 9) is present (e.g., arising from electrical operations) between the contact faces 227,229, the solenoid 13, when energized by the open coil 81, may not be capable of opening such weld. In order to assist the solenoid 13, the pivot opening 208 for the pivot legs 206 of the secondary movable contact arm 202 is opened up or elongated, in order to permit sufficient movement. As shown in FIG. 8, the closed state is defined by the lower or second or actuating position (FIG. 3) of the solenoid plunger 87, with the pivot legs 206 engaging the lower or second end 209 of the pivot opening 208 and being apart from the upper or first end 207 of such pivot opening. When the secondary separable contacts 228 are welded closed, the solenoid 13 may provide insufficient force to move the solenoid plunger 87 to the upper or first or deactuating position until after the pivot legs 206 move apart from the lower or second end 209 of the pivot opening 208 and at least substantially toward the upper or first end 207 of such pivot opening.

As shown in FIG. 9, the solenoid plunger 87 has a pivot position intermediate the deactuating position (FIG. 10) and the actuating position (FIG. 8). The movement of the plunger 87 from the actuating position to the pivot position (FIG. 9) moves the pivot legs 206 of the secondary movable contact arm 202 to the upper (with respect to FIG. 9) end 207 of the pivot opening 208, thereby allowing the secondary movable contact 226 to perform a peeling action with respect to the secondary fixed contact 230. This action helps to tear open the light tack weld 231. When the pivot legs 206 engage the first or upper end 207 of the pivot opening 208 and are apart from the second or lower end 209 of such pivot opening 208, the pivot state is provided. Thus, the first portion 218 of the movable contact arm 202 moves to that upper longitudinal position in the pivot state (FIG. 9) and remains there in the open state (FIG. 10).

After the light tack weld 231 is broken, the set of secondary contacts 228 open to the fully open state of the solenoid 13 of FIG. 3 and the secondary movable contact arm 202, as shown in FIG. 10. This open state is defined by the first or upper position of the solenoid plunger 87, with the pivot legs 206 engaging the first or upper end 207 of the pivot opening 208 and being apart from the second or lower end 209 of such pivot opening.

With the set of secondary contacts 228 closed, as best shown in FIG. 3, the coupling pin 107 is depressed, thereby driving the plunger 87 downward to open a gap 125 between the core 83 and the plunger 87, in order that such set of secondary contacts is closed and held closed by the spring 69'. However, with the set of secondary contacts 228 open, as shown in FIG. 10, the plunger 87 engages the core 83 in the first or upper position. In accordance with an important aspect of the present invention, the plunger 87 is set apart from the core 83 with a relatively smaller gap 125' in the third or pivot position of FIG. 9. In contrast, the plunger 87 is further set apart from the core 83 with the larger gap 125 in the closed position of FIG. 8. As a result, when the opening coil 81 is energized, the solenoid core 83 attracts the plunger 87 with a relatively greater force in the pivot position (FIG. 9), and with a relatively smaller force in the closed position (FIG. 8). Hence, the elongated pivot opening 208 permits the plunger 87 to freely move the secondary movable contact arm 202 to the pivot state of FIG. 9, even in the presence of a relatively light tack weld 231 on the separable contact faces 227,229. Then, in the pivot position (FIG. 9), the solenoid gap is reduced (e.g., from gap 125 to gap 125'), thereby providing greater solenoid force to break the relatively light tack weld 231 as the secondary movable contact arm 202 moves from the pivot position of FIG. 9 to the open position of FIG. 10.

Although the invention has been disclosed in connection with the circuit breaker 200 including the exemplary operating mechanism 7 and thermal-magnetic trip device 9, the invention is applicable to a wide range of circuit breakers, with or without circuits 243,244, employing a wide range of operating mechanisms and/or one, two or more sets of separable contacts, with or without an operating member/indicator member, such as 101, and/or trip mechanisms, with or without bimetal conductors, such as 39.

Although a remote controlled circuit breaker having sets of main and secondary contacts is shown, the invention is applicable to a wide range of electrical switching apparatus, such as other circuit breakers, electrical contactors and electrical relays, whether actuated by a solenoid or motor, where a moving conductor or movable contact arm is actuated by an actuator mechanism, which does not generate sufficient force to break a light tack weld between the faces of one or more sets of separable contacts.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof

What is claimed is:

1. An electrical switching apparatus comprising:

a housing comprising a pivot opening having a first end and a second end;

a movable arm including a first portion having a pivot pivotally mounted in said pivot opening and a second portion, said pivot opening being substantially larger than said pivot;

a fixed contact mounted in said housing;

a movable contact mounted on the second portion of said movable arm, said fixed contact, said movable contact and said movable arm cooperating to provide a closed state, a pivot state and an open state;

an actuator mounted in said housing, said actuator including a member coupled to said movable arm, said actuator moving said member between a first position and a second position to provide said open state and said closed state, respectively, said member having a third position between the first position and the second position; and means for biasing said movable arm toward said fixed contact to maintain said closed state;

wherein said closed state is defined by the second position of the member of said actuator, with said pivot engaging the second end of said pivot opening and being apart from the first end of said pivot opening, wherein said pivot engages the first end of said pivot opening and is apart from the second end of said pivot opening in said pivot state, wherein said open state is defined by the first position of the member of said actuator, with said pivot engaging the first end of said pivot opening and being apart from the second end of said pivot opening, and wherein when said fixed contact and said movable contact are welded closed, said actuator provides insufficient force to move the member of said actuator to said first position until after said pivot moves apart from the second end of said pivot opening and at least substantially toward the first end of said pivot opening.

2. The electrical switching apparatus of claim 1 wherein said actuator is a solenoid having a core and at least one coil wound on said core; and wherein said member is a plunger of said solenoid.

3. The electrical switching apparatus of claim 2 wherein said plunger engages said core in said first position, is set apart from said core with a first gap in said third position, and is further set apart from said core with a larger second gap in said second position.

4. The electrical switching apparatus of claim 3 wherein said at least one coil includes a closing coil and an opening coil; and wherein when said opening coil is energized said core attracts said plunger with a first force in said third position, and a second smaller force in said second position.

5. The electrical switching apparatus of claim 1 wherein said means for biasing said movable arm toward said fixed contact reduces a force applied to said movable arm and toward said fixed contact as said actuator moves said member from said second position at least substantially toward said third position, which moves said pivot from the second end of said pivot opening at least substantially toward the first end of said pivot opening.

6. The electrical switching apparatus of claim 5 wherein said means for biasing comprises a spring having a spring force applied to said movable arm, said spring force reducing as said actuator moves said member from said second position at least substantially toward said third position.

7. The electrical switching apparatus of claim 1 wherein said pivot has a size within said pivot opening; and wherein a distance between the first end and the second end of said pivot opening is about twice the size of said pivot.

8. A remotely controllable circuit breaker comprising:

a housing comprising a pivot opening having a first end and a second end;

a first terminal;

a second terminal;

a set of first contacts mounted in said housing;

an operating mechanism mounted in said housing and coupled to said set of first contacts for opening and closing said set of first contacts;

a movable arm including a first portion having a pivot pivotally mounted in said pivot opening and a second portion, said pivot opening being substantially larger than said pivot;

a set of second contacts comprising a fixed contact mounted in said housing and a movable contact mounted on the second portion of said movable arm, said fixed contact, said movable contact and said movable arm cooperating to provide a closed state, a pivot state and an open state, said set of second contacts being electrically interconnected with said set of first contacts between said first and second terminals;

a remotely controllable solenoid including a member coupled to said movable arm, said remotely controllable solenoid moving said member between a first position and a second position to provide said open state and said closed state, respectively, said member having a third position between the first position and the second position; and means for biasing said movable arm toward said fixed contact to maintain said closed state, wherein said closed state is defined by the second position of the member of said actuator, with said pivot engaging the second end of said pivot opening and being apart from the first end of said pivot opening, wherein said pivot engages the first end of said pivot opening and is apart from the second end of said pivot opening in said pivot state, wherein said open state is defined by the first position of the member of said actuator, with said pivot engaging the first end of said pivot opening and being apart from the second end of said pivot opening, and wherein when said fixed contact and said movable contact are welded closed, said actuator provides insufficient force to move the member of said actuator to said first position until after said pivot moves apart from the second end of said pivot opening and at least substantially toward the first end of said pivot opening.

9. The remotely controllable circuit breaker of claim 8 wherein said remotely controllable solenoid includes a core and at least one coil wound on said core; and wherein said member is a plunger of said remotely controllable solenoid.

10. The remotely controllable circuit breaker of claim 9 wherein said plunger engages said core in said first position, is set apart from said core with a first gap in said third position, and is further set apart from said core with a larger second gap in said second position.

11. The remotely controllable circuit breaker of claim 10 wherein said at least one coil includes a closing coil and an opening coil; and wherein when said opening coil is energized said core attracts said plunger with a first force in said third position, and a second smaller force in said second position.

12. The remotely controllable circuit breaker of claim 8 wherein said set of second contacts is a set of secondary contacts; wherein said fixed contact is a secondary fixed contact; wherein said movable contact is a secondary movable contact; wherein said set of first contacts is a set of main contacts comprising a main fixed contact electrically connected to said first terminal and a main movable contact; and wherein said operating mechanism comprises a main movable arm carrying said main movable contact.

13. The remotely controllable circuit breaker of claim 8 wherein said pivot has a size within said pivot opening; and wherein a distance between the first end and the second end of said pivot opening is about twice the size of said pivot.

14. The remotely controllable circuit breaker of claim 8 wherein said fixed contact and said movable contact include opposing faces, which are engaged in said closed state and are disengaged in said open state; and wherein when said opposing faces are welded closed, said pivot state separates a portion of the opposing face of said movable contact from the opposing face of said fixed contact.

15. The remotely controllable circuit breaker of claim 14 wherein said opposing faces have an arcuate cross-section.

16. An electrical switching apparatus comprising:

a housing;

a movable arm including a first portion and a second portion;

means for mounting the first portion of said movable arm for pivotal movement and longitudinal movement with respect to said housing;

a fixed contact mounted in said housing;

a movable contact mounted on the second portion of said movable arm, said fixed contact, said movable contact and said movable arm cooperating to provide a closed state, a pivot state and an open state; and an actuator mounted in said housing, said actuator including a member coupled to said movable arm, said actuator moving said member between a deactuating position and an actuating position to provide said open state and said closed state, respectively, said member having a pivot position between the deactuating position and the actuating position, wherein said closed state is defined by the actuating position of the member of said actuator, wherein said first portion of said movable arm moves to a first longitudinal position in said pivot state and in said open state, wherein said first portion of said movable arm moves to a second longitudinal position in said closed state, and wherein when said fixed contact and said movable contact are welded closed, said actuator provides insufficient force to move the member of said actuator to said deactuating position until after said first portion of said movable arm moves at least substantially toward the first longitudinal position in said pivot state.

17. The electrical switching apparatus of claim 16 wherein said actuator is a solenoid having a core and at least one coil wound on said core; and wherein said member is a plunger of said solenoid.

18. The electrical switching apparatus of claim 17 wherein said plunger engages said core in said deactuating position, is set apart from said core with a first gap in said pivot position, and is further set apart from said core with a larger second gap in said actuating position.

* * * * *